United States Patent [19]

Mizelle

[11] 4,408,796

[45] Oct. 11, 1983

[54] MECHANISM FOR PROVIDING ANGULAR ADJUSTABILITY TO LEGREST OF RECLINER ONLY WHEN PROJECTED

[75] Inventor: Ned W. Mizelle, High Point, N.C.

[73] Assignee: The Lane Company, Inc., Altavista, Va.

[21] Appl. No.: 220,859

[22] Filed: Dec. 29, 1980

[51] Int. Cl.[3] ..... A47C 1/02

[52] U.S. Cl. ..... 297/85; 297/69; 297/70; 297/89

[58] Field of Search ..... 297/69, 70, 68, 85, 297/84, 89, 431

[56] References Cited

U.S. PATENT DOCUMENTS

| | | | |
|---|---|---|---|
| 1,650,826 | 11/1927 | Fargo | 297/70 |
| 2,968,339 | 1/1961 | Hoffman, Jr. | 297/89 |
| 3,047,336 | 7/1962 | Schliephacke | 297/85 |
| 3,550,952 | 12/1970 | Ferguson | 297/85 |
| 3,695,701 | 10/1972 | Knabusch et al. | 297/69 X |

FOREIGN PATENT DOCUMENTS

| | | | |
|---|---|---|---|
| 530589 | 8/1954 | Belgium | 297/84 |
| 661131 | 4/1963 | Canada | 297/68 |
| 2025214 | 1/1980 | United Kingdom | 297/431 |

*Primary Examiner*—James T. McCall

*Attorney, Agent, or Firm*—Cushman, Darby & Cushman

[57] ABSTRACT

The legrest projecting/retracting linkages of a recliner chair mechanism are designed to progressively provide pivotability for the legrest as the legrest nears its fully projected condition, i.e. is about three-quarters or more of the way out, and to progressively inhibit that pivotability in the initial stage of retraction of the legrest from its fully projected condition, i.e. in the first-quarter of its retraction. This may be accomplished without reworking the remainder of most existing recliner chair mechanisms. A number of ways that the legrest projecting/retracting linkages can be configured to achieve this objective are disclosed.

9 Claims, 12 Drawing Figures

TOO SHORT

JUST RIGHT

TOO TALL

MECHANISM FOR PROVIDING ANGULAR ADJUSTABILITY TO LEGREST OF RECLINER ONLY WHEN PROJECTED

BACKGROUND OF THE INVENTION

When people sit in recliner chairs, as in other chairs, some sit up and others slouch, some are long-legged and others are relatively shorter from foot-sole to knee or from knee to hip.

Recliner chairs which are internally structurally identical, even to use of identical recliner mechanisms (i.e. the chair "hardware"), may be upholstered in very different styles, with differing seat cushion-to-floor distances.

FIGS. 1, 2 and 3 are schematic views illustrating what impact the foregoing may have upon a rocker recliner chair user. In each of these figures, a stick figure representing a person is shown seated in a recliner chair which is in a fully reclined position, with its legrest fully extended.

FIG. 2 shows the ideal condition, where the combination of chair design, hardware and upholstery and the user's stature and posture is such that the fully projected legrest L has an angle $\alpha$ of its support surface for the backs of the legs of the chair user where they are supported on the legrest L, which fully matches the comparable angle $\beta$ at which the backs of the user's legs extend relative to his or her knees. In this ideal situation the user is not discomforted at any place on the backs of his or her legs where they rest on the legrest, because the contact pressure on each leg is spread out over a relatively large leg back/legrest area extending from the upper, rear edge to the lower, forward edge of the legrest.

FIG. 1, in contrast illustrates how the legrest L may press its upper rear edge portion discomfortingly against the leg backs of a user who is relatively shorter or is sitting-up relatively straighter than the idealized average person for whom the manufacturer built the chair. Here is a mis-match, the legrest support surface angle $\alpha$ is greater than the natural leg angle $\beta$.

FIG. 3 illustrates how at the other extreme the legrest L may press its lower, forward edge portion discomfortingly against the leg backs of a user who is relatively taller or is slouching relatively more than the idealized average person for whom the manufacturer built the chair.

The problem illustrated by FIGS. 1 and 3 is only existant in the usual recliner chair when the legrest is fully or substantially fully projected, since, up until that point, a mis-match between user and legrest can be overcome by projecting or retracting the legrest somewhat until a comfortable matching angle $\alpha \cong \beta$ is achieved. (In the usual recliner chair, the angle $\alpha$ progressively changes from generally vertical to generally horizontal with progressive projection of the legrest from the fully retracted condition.)

In short, the typical prior art recliner chair has had its projected legrest angle of disposition set for comfort for only a selected swath of the full range of potential users. This has cost lost sales, where the person the legrest did not fit is the shopper. And it has reduced the number of people who would frequently use and enjoy the recliner chair in any particular home. From a manufacturer's viewpoint, the fact that a chair is not used as much as it might be is detrimental, because it pushes-off further into the future the day that the chair will wear out and need to be replaced.

A prior art solution which has not found wide acceptance is to pivotally mount the left and right ends of the legrest to the left and right legrest projecting/retracting linkages of the recliner chair mechanisms, so that at all times the legrest may be angularly adjusted. There are several reasons for the failure of this technique as a general solution: Legrest pivotability is undesirable as the legrest is being retracted, since, especially with legrests with rearwardly projecting wings, for T-cushion upholstered chairs, the wings of a tilted-up legrest could jam against the floor preventing full retraction. After a chair had been broken-in through usage, the legrest could refuse to stay put when fully retracted, and adopt a frowning look. Recliner mechanisms generally are worked-out to go smoothly through their motions, and when the legrest suddenly becomes free to tilt or suddenly is forced, e.g by banging against the floor, to assume a different angle, the abrupt change in the "feel" of the movement is discomforting to the average user.

SUMMARY OF THE INVENTION

The legrest projecting/retracting linkages of a recliner chair mechanism are designed to progressively provide pivotability for the legrest as the legrest nears its fully projected condition, i.e. is about three-quarters or more of the way out, and to progressively inhibit that pivotability in the initial stage of retraction of the legrest from its fully projected condition, i.e. in the first-quarter of its retraction. This may be accomplished without reworking the remainder of most existing recliner chair mechanisms. A number of ways that the legrest projecting/retracting linkages can be configured to achieve this objective are disclosed.

The principles of the invention will be further discussed with reference to the drawings wherein preferred embodiments are shown. The specifics illustrated in the drawings are intended to exemplify, rather than limit, aspects of the invention as defined in the claims.

Four embodiments of the invention are described with regard to FIGS. 4-12. Because the mechanism linkages at the left and right of a recliner chair are, as far as is relevant here, mirror image duplicates of one another, only the left side (facing) linkage is shown. Further, because provision of the structure of the present invention does not require modification to the remainder of the chair hardware, all behind the four-bar linkage of the legrest projecting/retracting means has been broken away and not depicted. All four bars of the four bar linkage are shown only in FIGS. 4-6. In the remaining figures the rear bar is omitted and the top and bottom bars have only their forward end portions shown.

Figure 1:
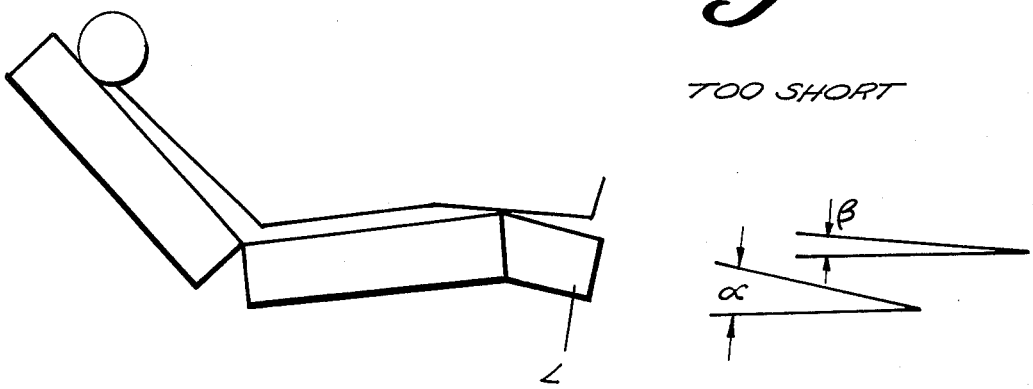
FIGS. 1-3 are described hereinbefore under the heading *Background of the Invention.*
Figure 2:
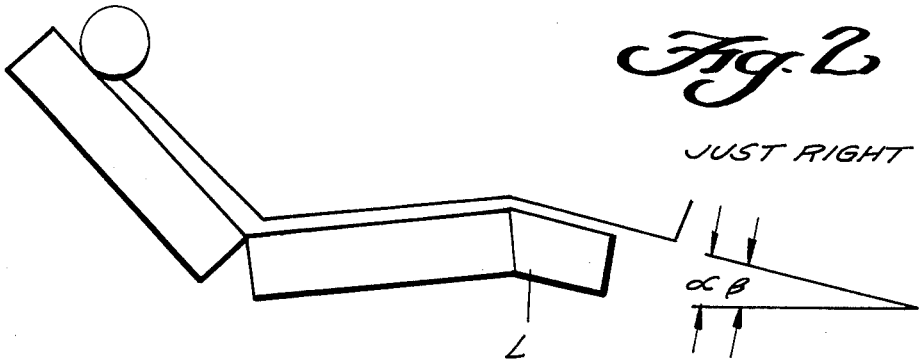
Figure 3:
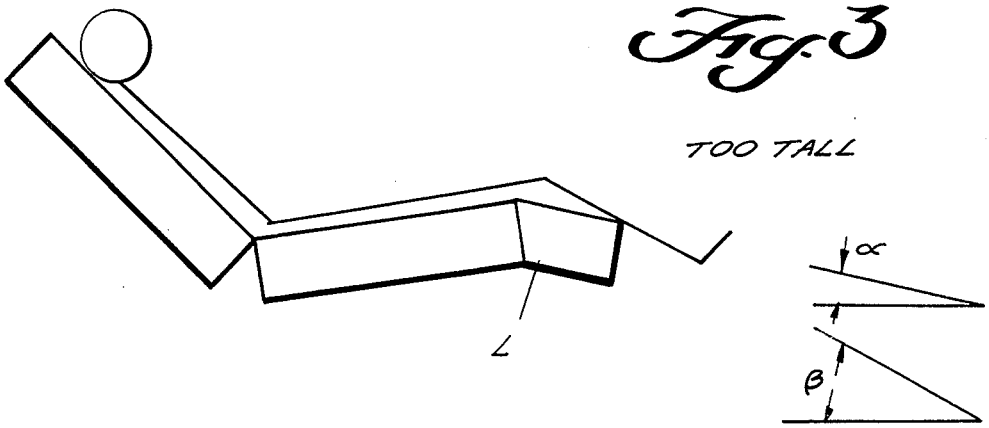
Figure 5:
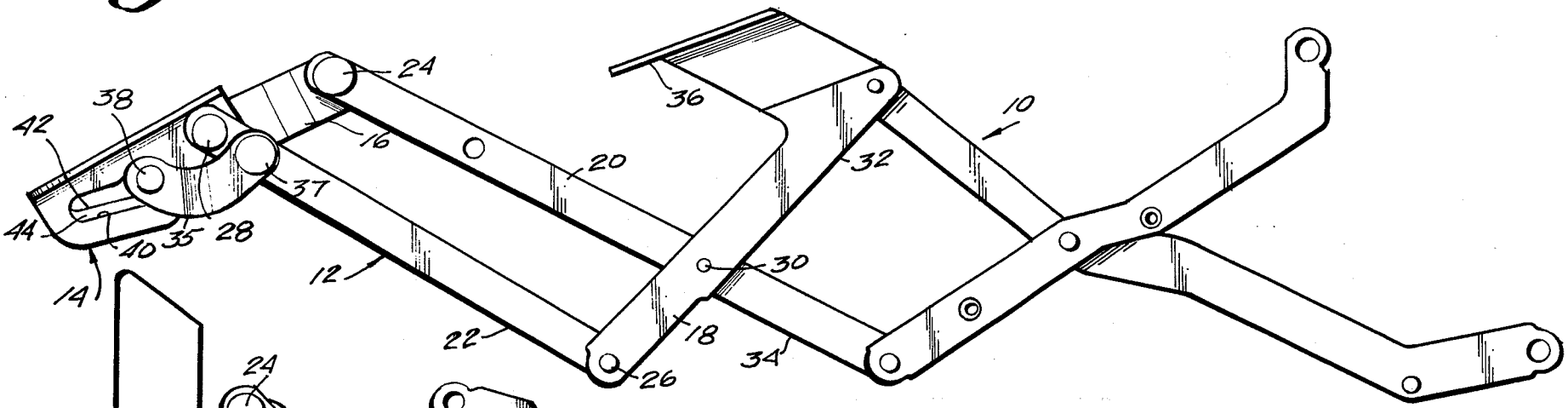
Figure 4:
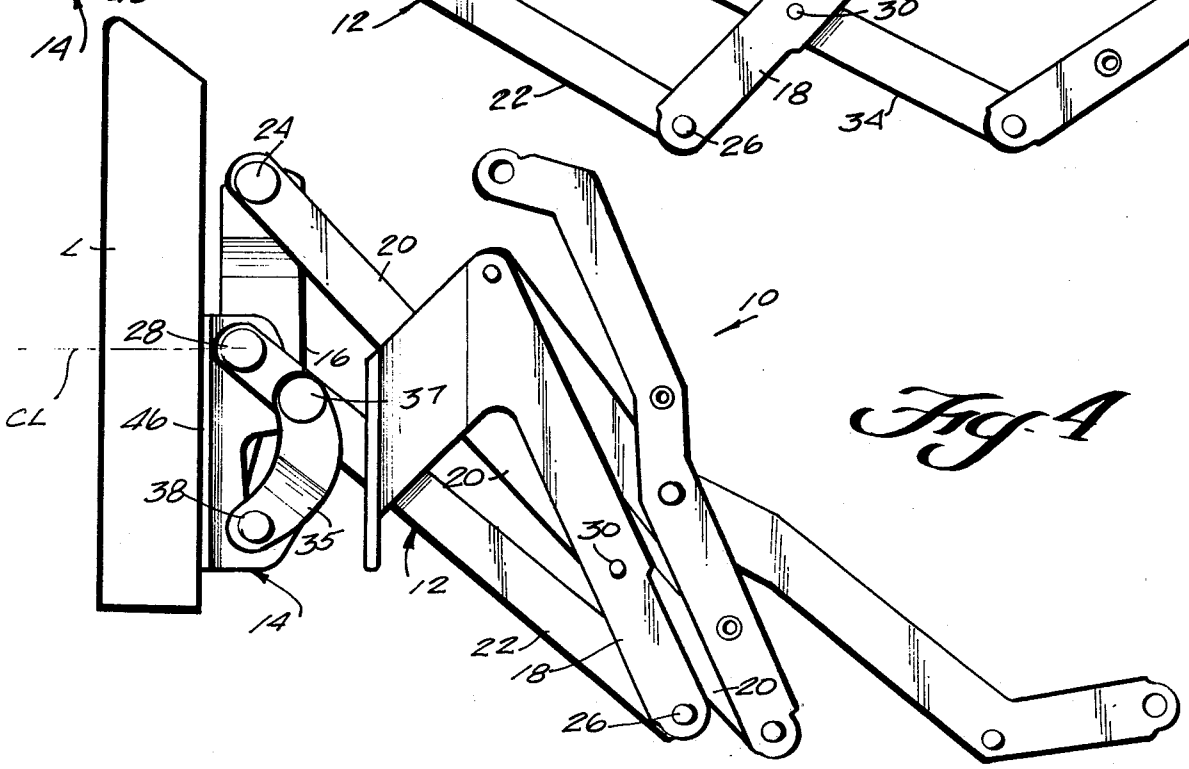

FIGS. 4 and 5 show a first embodiment of the invention in the fully retracted and fully projected conditions, respectively.

Figure 6:
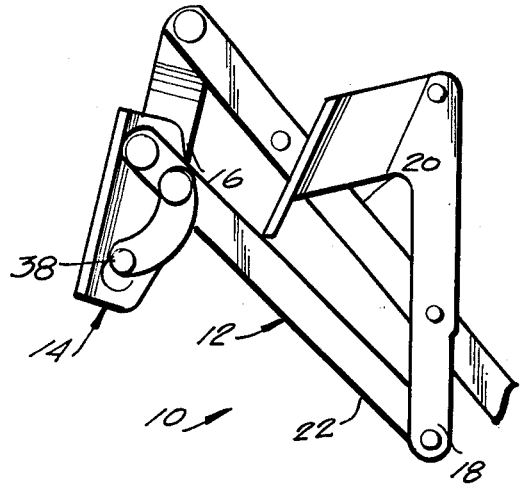

FIG. 6 is a smaller-scale view, showing the four-bar linkage of the lazy tong means in a partly extended, partly retracted condition.

Figure 7:
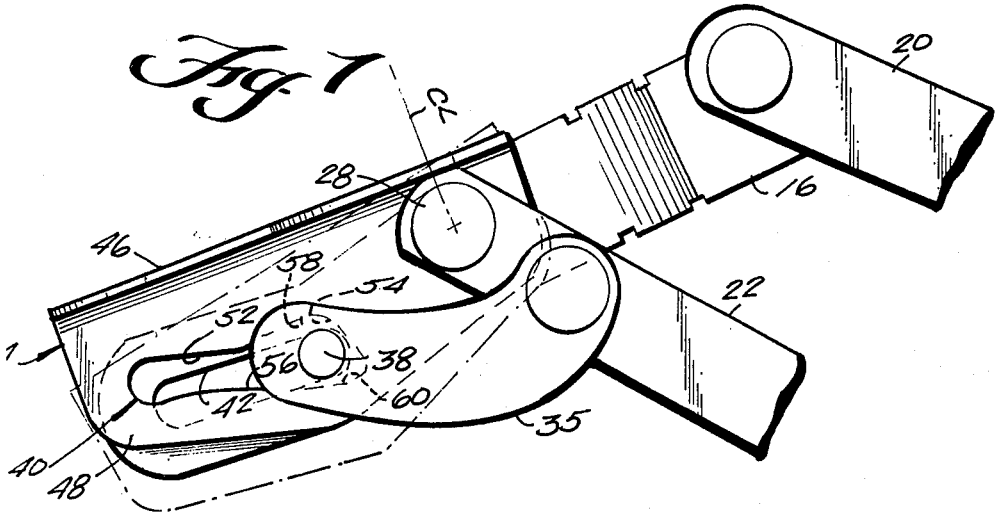

FIG. 7 is a larger scale view of the legrest mounting site, as it appears when the legrest mounting link is fully extended one extreme of angular disposition of legrest mounting bracket being shown in solid lines and the other being shown in dashed lines.

Figure 8:
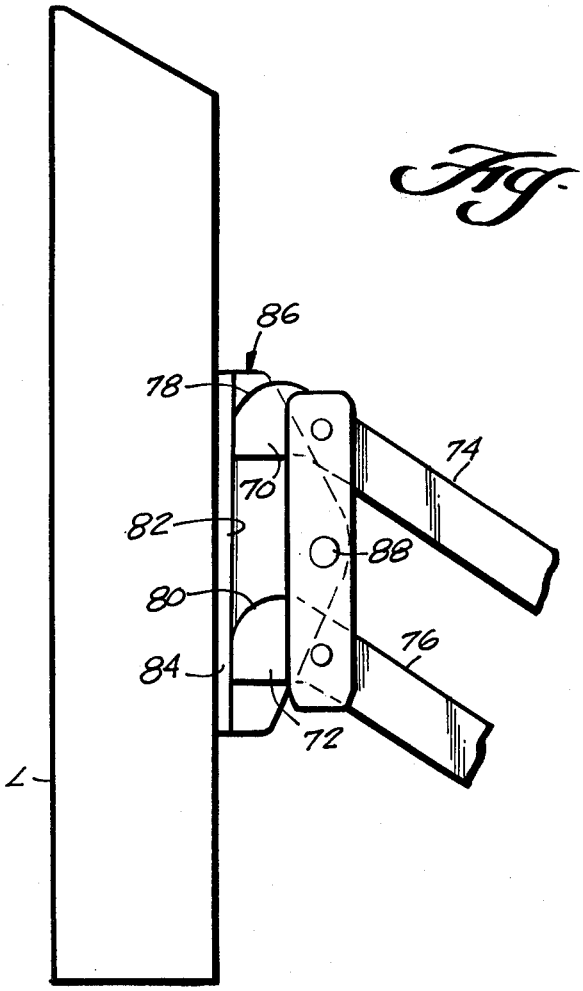
Figure 9:
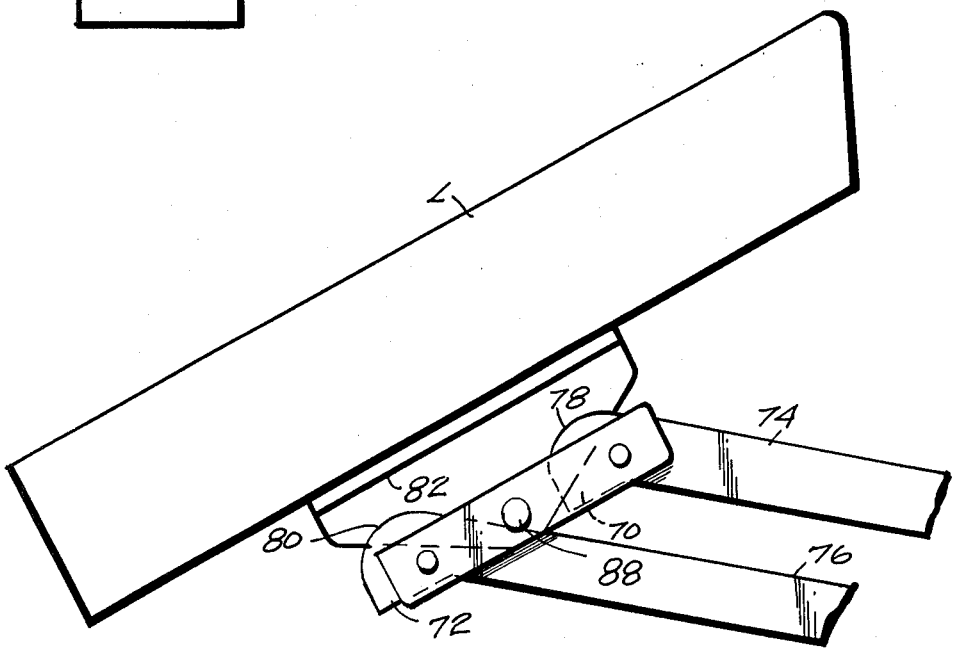

FIGS. 8 and 9 show a second embodiment of the invention in the fully retracted and fully projected conditions, respectively.

Figure 10:
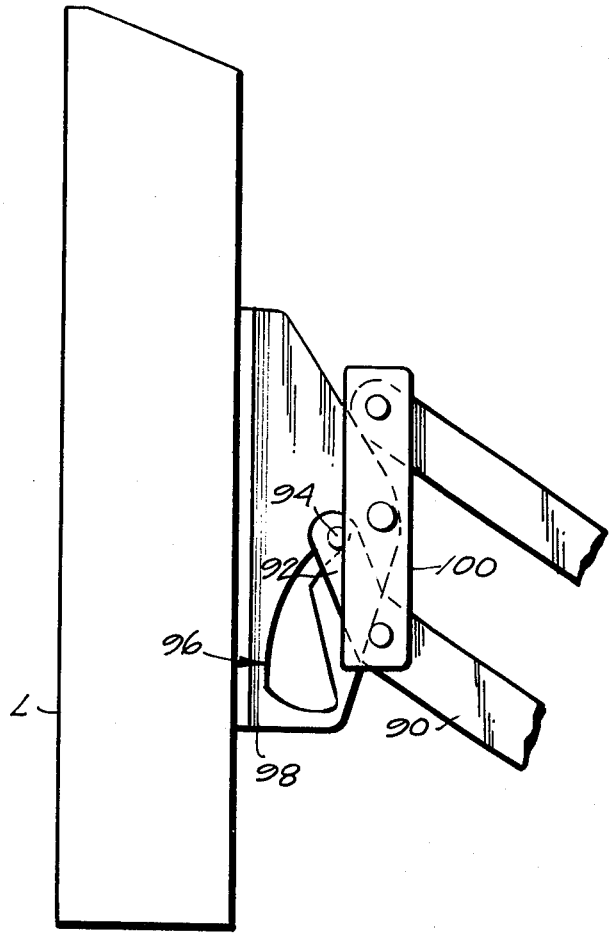
Figure 11:
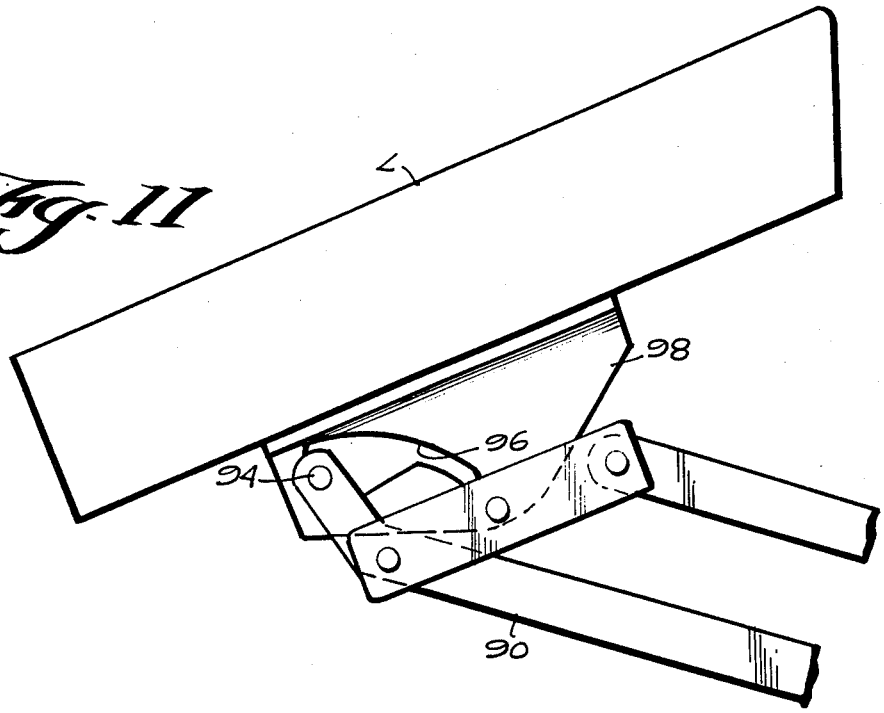

FIGS. 10 and 11 show a third embodiment of the invention in the fully retracted and fully projected conditions, respectively.

Figure 12:
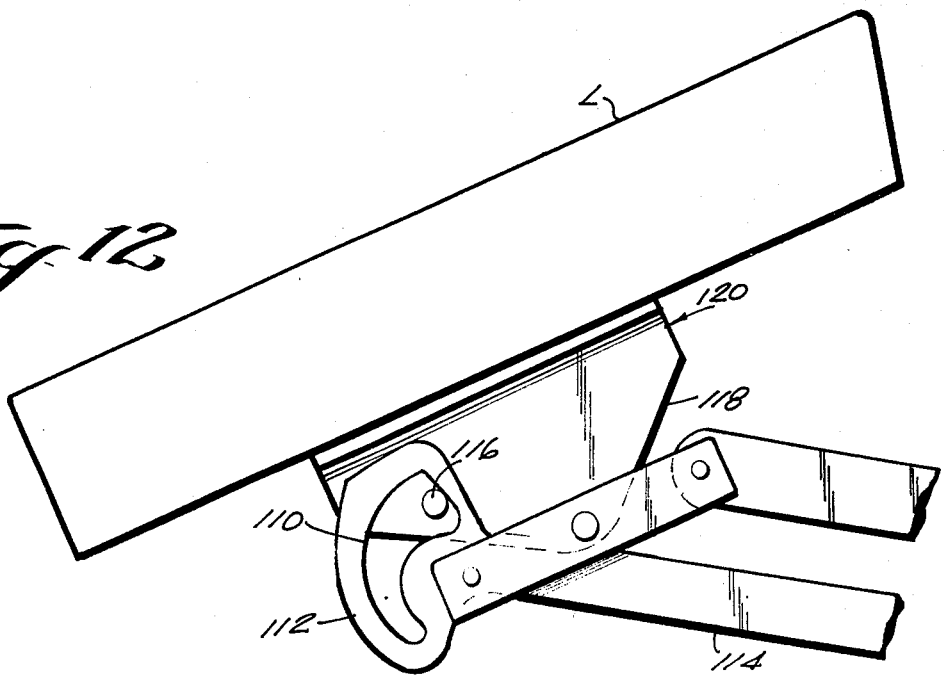

FIG. 12 shows a fourth embodiment of the invention in the fully projected condition.

DETAILED DESCRIPTION

The mechanism structure 10 that one sees in FIGS. 4 and 6 is the outer end portion 12 of a lazy tongs means that is shown in its retracted condition. Normally the unshown inner end of this lazy tongs is based on the recliner mechanism of or for a recliner chair, and the outer end portion that is shown is cantilevered relative to such basing. This portion is constituted by a four-bar linkage, and has a legrest mounting bracket 14 mounted to the outer end member 16 of the four-bar linkage 12.

The four-bar linkage includes, beside the outer end member 16, an inner end member 18, an upper member 20 and a lower member 22. Two of the pivot joints 24 and 26 are placed where two respective members cross at respective ends. The forward end and lower bars cross at a pivot joint 28 that is located at the forward end of the lower member but intermediate the upper and lower ends of the forward end member. The upper and rear members cross intermediate their ends so that the fourth pivot joint, 30, is provided at the intermediate site where these two members cross. The end portions 32, 34 of the members 18, 20 which extend outside the four-sided figure of the four-bar linkage function like scissors handles. When these "handles" 32, 34 are rotated towards one another about the pivot joint 30, the lazy tongs means is extended (i.e. is moved towards the condition shown in FIG. 5). When the members 32, 34 are rotated towards one another, the lazy tongs means is retracted (i.e. is moved towards the condition shown in FIG. 4).

The end portion 32 is shown having a medially-directed flange 36 extending integrally therefrom. In a typical construction this would be provided so that the lazy tongs at this left side of the chair (not shown) could be connected by a rigid cross piece (not shown) to the similar lazy tongs (not shown) at the right side of the chair.

Although the lazy tongs handles 32, 34 are shown provided as extensions from the upper rear corner of the four bar linkage, they could be provided from the lower rear corner of the four bar linkage.

In the arrangement shown, some of the links are in different planes so that they can move into relatively overlapping relation. By way of example, in the construction shown in FIG. 6, the upper and lower members 20 and 22 lie in an intermediate plane, the inner end member 18 lies in a more medial plane (closer to the viewer) and the outer end member 16 lies in a more lateral plane (further from the viewer).

All that has been described so far is (with the possible exception of having the outer end member 16 of the four-bar linkage extend down beyond the pivot joint 28) is utterly typical and conventional.

What is different is how the legrest mounting bracket 14 is connected to the four-bar linkage 12. In the prior art, it is generally either rigidly connected with, even to the degree of being integrally provided on, the outer end member 16 or else it is pivotally mounted to the outer member 16 or otherwise to the outer end of the four-bar linkage for being always pivotal to a limited degree with respect thereto, so long as the legrest is not so retracted as to abut the chair chassis.

What is accomplished is to make the legrest/four-bar linkage connection be substantially rigid throughout the inner major portion of the range of extension of the lazy tongs means and progressively more angularly freely pivotal in and toward the outer extreme of this range. In other words, this makes it so that the angle $\alpha$ can only be changed (without further projecting or retracting the legrest mechanism structure 10) only when the legrest is a majority of the way out, e.g. three-quarters or more of the way from the fully retracted condition shown in FIG. 4 towards the fully projected condition shown in FIG. 5.

How this is done is to pivotally mount the legrest at the forward end of the four-bar linkage, but to impose a control means between the four-bar linkage and the legrest mounting bracket that will prevent the legrest from pivoting unless the lazy tongs means is nearly fully extended.

How the disclosed embodiments differ from one another is in the specific structure of this control means.

FIRST EMBODIMENT

In the FIGS. 4–7 version, the control is provided by a control link 35 that has one end pivotally connected to the four-bar linkage in the vicinity of but at some remove from the forward lower corner pivot joint 28. As shown, this pivotal connection 37 is to the lower member 22. The other end of the control link 35 carries a laterally directed pivot pin 38 which is captured in two slots: a first slot 40 in the legrest mounting flange and a second slot 42 in the portion 44 of the four-bar linkage outer end member 16 that extends below the pivot joint 28.

The legrest mounting bracket 14 is an angle member having a medially directed forward flange 46 and a rearwardly directed side flange 48. It is in the side flange 48 that the slot 40 is provided. Above the slot 40, the legrest mounting bracket is shown pivotally connected to the lazy tongs means by the pivot joint 28 that pivotally joins the upper end of the side flange 48 to the outer lower corner of the four-bar linkage, e.g. between the respective ends of the outer and lower members of the four bar linkage. This connection is preferably substantially on the center line CL of the legrest L that is to be mounted to the flange 46.

In this first embodiment, the second slot 42, that one that is in the portion 44 of the outer end link 16 is straight, parallel-sided and concavely round-ended, but the first slot 40, the one that is in the side flange 48 of the legrest mounting bracket 14 is shaped more like a pear, an Ehrlenmeier flask, an Italian tomato, a one-ended dog bone or bow tie, or a Schmoo. That is, this slot 40 has a neck portion 52 that is substantially parallel-sided much like the comparable part of the second slot 42, and an enlarged body portion 54 which gradually enlarges from where it joins the neck portion 52 towards its furthest extent from the neck portion.

The slots 40 and 42 are so oriented on the respective parts in which they are provided, that they are generally parallel and generally coterminous for all phases of movement of extending and retracting the lazy tongs means.

When the lazy tongs means is fully retracted (FIG. 4), the pin 38 is at the mutual lower ends of the slots 40 and 42. (The lower end of the slot 40 being its neck end, with the body end of this slot being disposed upwards therefrom.)

As the lazy tongs means is extended, the control link moves the pin 38 along both slots toward the condition shown in FIG. 5, where the slot 42 is still as narrow as it was, but the slot 42 is broader. This, as soon as the pin gets into the region at 56 where the slot 40 begins to become broader, is what permits the bracket 16 to become pivotal about the axis of the joint 28, to the degree depicted in FIG. 7, i.e. by alternative abutment of the pin 38 with the sides 58, 60 of the body portion of the slot 40. Because the pivot joint for the bracket 16 is on the center line CL, the mechanism is equally well suited to accommodate chair-users which fall on opposite sides of the average user for which the chair is constructed.

It should be apparent that what is described above can, as to some details be done differently without changing matters much. For instance, the pivot joint for the bracket 16 could be provided separately from the pivot joint 28. It is convenient, though, to merge these structures into one, as shown.

The device 10 may be made of the usual materials, e.g. steel plate, painted flat black with upset-ended solid or tubular pins for pivot joints and the pin 38. Where desired annular spacers or bearing bushings of metal or lubricuous plastic such as nylon may be used as is conventional, fabrication may be by conventional techniques.

SECOND EMBODIMENT

Referring to FIGS. 8 and 9, everything is the same as in the first embodiment, except for the structure of the control means, which follows:

The outer ends 70, 72 of the upper and lower links 74, 76 of the four-bar linkage are provided with convexly curved cam lobe surfaces 78, 80 sized, shaped and positioned to be in slidingly engaging relation with the rear face 82 of the lateral flange 84 of the legrest mounting bracket 86, when the lazy tongs means is fully retracted (FIG. 8), and all of the time that the lazy tongs means is more than a majority of the way out, e.g. unless it is at least three-quarters of the way out. From that point until when the legrest is fully projected (FIG. 9) the surfaces 78, 80 are progressively further withdrawn from contact with the flange 84, so that the amplitude with which the legrest support bracket is free to pivot about the pivot joint 88 where it is pivotally secured to the four-bar linkage is correspondingly increased.

A similar means could be provided by leaving one of the surfaces 78 or 80 always in contact but having the other to be moved away as described. If all else were equal this would provide a correspondingly lower maximum amplitude of rockability at full projection of the legrest, but if the cam surface 78 or 80 that is to be moved away is angled back more sharply in the region where it is to be spaced away, an equivalent amplitude of rockability stage-for-stage can be provided.

THIRD EMBODIMENT

In a broad sense, the version shown in FIGS. 10 and 11 is nothing more than a duplication of the first embodiment, except that here, the control link is made integral with the lower link 90 of the four-bar linkage as a forward extension 92 thereof. The lateral pin 94 on the forward end of the extension 92 is captured in the pear-shaped slot 96 formed in the side flange 98 of the legrest supporting bracket, which slot may have the shape and orientation shown. Here, the pin 94 is not shown also riding in a slot in the outer end member 100 of the four-bar linkage, but it could be, comparably to the way it is done in the first embodiment. Likewise, the pin-in-slot arrangement of the first embodiment could omit having the pin 38 ride in a slot in the outer end member 16 of the four-bar linkage. This back-up slot for the actual cam slot provides strengthening and anti-cocking functions that can be done without when not needed or when provided in some other fashion.

FOURTH EMBODIMENT

FIG. 12 depicts a reversal of parts compared with what is shown in FIG. 11.

Here, the pear-shaped cam slot 110 is provided on the forward extension 112 of the lower bar 114 of the four-bar linkage and the laterally projecting follower pin 116 is provided on the side flange 118 of the legrest mounting bracket 120. The performance is the same as for embodiments one through three.

It should now be apparent that the mechanism for providing angular adjustability to legrest of recliner only when projected as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For a legrest projecting and retracting means of the lazy tongs type having a four-bar linkage, an improvement for permitting a legrest mounted thereto to become angularly rockable, only when the projecting and retracting means is more projected than retracted, said improvement comprising:

a legrest mounting bracket having means for securing a legrest thereto;

means pivotally securing said legrest mounting bracket to said four-bar linkage about a lateral pivot axis; and control means active between said four bar linkage and said legrest mounting bracket to prevent pivoting of said legrest mounting bracket about said lateral pivot axis unless said projecting and retracting means is more projected than retracted;

said control means comprising a lateral pin means provided on one of said legrest mounting bracket and said four-bar linkage and a cam slot means receiving said lateral pin means, said cam slot means being provided in the other of said legrest mounting bracket and said four-bar linkage.

2. The improved legrest projecting and retracting means of claim 1, wherein:

said cam slot means is pear-shaped so as to have a narrow neck portion and a body portion that is contiguous with and widens gradually from said neck portion, so that said angular rockability is progressively of greater amplitude in proportion to the degree of projection of the legrest projecting and retracting means when the legrest projecting and retracting means is more projected than retracted.

3. The improved legrest projecting and retracting means of claim 1, wherein:

the four-bar linkage includes a lower bar and an outer end bar;

said pivotally securing means pivotally secures the legrest mounting bracket to said outer end bar; and the one of said pin means and slot means which is provided on said four-bar linkage is provided on said lower bar.

4. The improved legrest projecting and retracting means of claim 3, further including:

a legrest secured to said legrest support bracket; and said pivotally securing means being located substantially at the level of the centerline of the legrest.

5. The improved legrest projecting and retracting means of claim 3, further including:

means providing a guide slot on said outer end bar, said guide slot being substantially parallel to and substantially coterminous with said slot means, said pin means also being received in said guide slot.

6. The improved legrest projecting and retracting means of claim 5, wherein:

said cam slot means is pear-shaped so as to have a narrow neck portion and a body portion that is contiguous with and widens gradually from said neck portion, so that said angular rockability is progressively of greater amplitude in proportion to the degree of projection of the legrest projecting and retracting means when the legrest projecting and retracting means is more projected than retracted.

7. The improved legrest projecting and retracting means of claim 3, wherein:

said four bar linkage includes an auxiliary control link pivotally secured to said lower link, said pin means being provided on said control link.

8. For a legrest projecting and retracting means of the lazy tongs type having a four-bar linkage, an improvement for permitting a legrest mounted thereto to become angularly rockable, only when the projecting and retracting means is more projected than retracted, said improvement comprising:

a legrest mounting bracket having means for securing a legrest thereto;

means pivotally securing said legrest mounting bracket to said four-bar linkage about a lateral pivot axis; and control means active between said four bar linkage and said legrest mounting bracket to prevent pivoting of said legrest mounting bracket about said lateral pivot axis unless said projecting and retracting means is more projected than retracted;

said four-bar linkage including an upper link having a forward end, a lower link having a forward end and an outer end link;

said pivotally securing means pivotally securing the legrest mounting bracket to said outer end link; and said control means comprising a convex cam lobe on at least one of said link forward means, and a cam lobe engagement surface on said legrest mounting bracket at some substantial removal from the level of said pivotally securing means;

said convex cam lobe and cam lobe engagement surface being mutually shaped and arranged to be in sliding engagement unless said legrest projecting and retracting means is more projected than retracted.

9. For a legrest projecting and retracting means of the lazy tongs type having a four-bar linkage, an improvement for permitting a legrest mounted thereto to become angularly rockable, only when the projecting and retracting means is more projected than retracted, said improvement comprising:

a legrest mounting bracket having means for securing a legrest thereto;

means pivotally securing said legrest mounting bracket to said four-bar linkage about a lateral pivot axis; and control means active between said four bar linkage and said legrest mounting bracket to prevent pivoting of said legrest mounting bracket about said lateral pivot axis unless said projecting and retracting means is more projected than retracted;

said four-bar linkage including an upper link having a forward end, and a lower link having a forward end and an outer end link;

said pivotally securing means pivotally securing the legrest mounting bracket to said outer end link; and said control means comprising a respective convex cam lobe on each of said upper and lower link forward ends, and a cam lobe engagement surface means on said legrest mounting bracket at some substantial remove from the level of said pivotally securing means;

said convex cam lobes and cam lobe engagement surface means being mutually shaped and arranged so that both said convex cam lobes are in sliding engagement with said cam lobe engagement surface means unless said legrest projecting and retracting means is more projected than retracted.

* * * * *